US007692915B1

(12) United States Patent
Nemtyshkin et al.

(10) Patent No.: US 7,692,915 B1
(45) Date of Patent: Apr. 6, 2010

(54) ELECTRIC SHOCK DEVICE

(76) Inventors: Oleg Nemtyshkin, Ofitserskaya str., 17, 173, Toliatty (RU) 445044; Yury Ladyagin, Bolshaya Gruzinskaya str., 39, 21, Moscow (RU) 123056

( * ) Notice: Subject to any disclaimer, the term of this patent is extended or adjusted under 35 U.S.C. 154(b) by 448 days.

(21) Appl. No.: 11/560,891

(22) Filed: Nov. 17, 2006

(51) Int. Cl.
*H01T 23/00* (2006.01)
*F41B 15/04* (2006.01)

(52) U.S. Cl. ..... 361/232

(58) Field of Classification Search ..... 361/232
See application file for complete search history.

(56) References Cited

U.S. PATENT DOCUMENTS 4,872,084 A * 10/1989 Dunning et al. ..... 361/232
7,102,870 B2 * 9/2006 Nerheim ..... 361/232

* cited by examiner

*Primary Examiner*—Fritz M. Fleming
*Assistant Examiner*—Lucy Thomas
(74) *Attorney, Agent, or Firm*—Ishman Law Firm P.C.

(57) ABSTRACT

An electroshock device with a more effective physiological impact uses Shaped Pulse technology and integrated STUN GUN/EMD technology to produce high-voltage pulse transformers, and is distinguished by the considerable visual effect of its demonstration release of electric discharge. In one embodiment, the device employs parameters of electric discharges having frequencies of 100-200 Hz with pulse energy of at least 0.1 J and a pulse duration up to 1000 milliseconds, which allows one to achieve the goal of stopping and capturing the target. In other embodiments, a series of impulses based on STUN GUN technology alternate with separate impulses based on EMD technology in a single, uninterrupted electric discharge by which the target-stopping and target-capturing mechanisms are attained.

12 Claims, 2 Drawing Sheets

ELECTRIC SHOCK DEVICE

FIELD OF INVENTION

This invention relates to weapons using electric media to strike a target remotely or by contact.

BACKGROUND OF THE INVENTION

There are widely known electroshock devices containing an autonomous electric power supply (storage cell or battery), a converter of the electric power supply's low-voltage direct current to direct current of 600-4000 volts, a storage capacitor and a circuit consisting of the sequentially engaged low-voltage coil of an output high-voltage pulse transformer and a switch for which, as a rule, a pneumatic or gas discharger is used with ignition voltage that is 15-50% less than the output voltage of the converter when empty, which are connected in parallel to the converter outlet. These devices have the following drawbacks:

1. A low performance index due to energy losses at the high-voltage output pulse transformer.

2. Insufficient duration and energy of the individual pulse for stopping a target, due to the insufficient induction coefficient of the known high-voltage pulse transformers in the requisite size for handheld devices, and the negligible performance index energy transmission from a large-capacity storage capacitor through a high-voltage pulse transformer to a target.

Contemporary notions on the physiological effectiveness of the impact of an electric shock impulse, corroborated by numerous experiments by a leading global manufacturer of a non-lethal electroshock weapon, Taser International, Inc. (USA), include two operative mechanisms of a physiologically effective electric impulse. The operative mechanism (technology) that was first studied and is used in an absolute majority of electroshock devices, called the STUN GUN, induces pain shock in the receptor nerve endings as a current of electric impulses of short duration (10-40 milliseconds) and negligible energy (0.05-0.1 J), with a frequency of about 100-200 Hz passes through the surface layers of the tissues and muscles. The effect of these impulses is to induce strong sensations of paid, which cannot stop an attacker having a substantial pain threshold. However, such impulses have considerable aftereffects, from several seconds to several minutes, after the current ceases, expressed in numbness, trembling, muscle contractions around the area where voltage was applied, and general unpleasant sensations that prevent the attacker from taking effective action during the indicated time period following the impact of the electroshock device. This condition that follows the use of the electroshock device against an attacker makes it relatively easy to capture (e.g., handcuff) him.

The second operative mechanism (technology) that uses an electric impulse, called the EMD [Electro-Muscular Disruption] effect, overwhelms the skeletal musculature due to the penetration of high-energy current (no less than 1.76 J) at a frequency of 10-30 Hz into the deep muscle layers. The passage of such impulses induces negligible pain sensations since the current travels below the receptor nerve endings, but at the same time the skeletal muscles are completely overwhelmed and cannot be directed at will. These impulses can stop an attacker with any pain threshold, leading to the attacker's falling down, virtually regardless of where the current is applied (trunk or extremity). However, these impulses have virtually no aftereffects (that is, after the current ceases to run through the target, no subsequent unpleasant sensations are observed that might reduce the target's level of activity), which precludes capturing the attacker after the current's effect ceases.

To the present day, attempts to combine the effects of the STUN GUN and EMD technologies in a single electrical impulse in standard high-voltage pulse transformers with a duration of 30-40 milliseconds, uniting the operative mechanisms of both impulses, have yielded no success, due to the varied depth at which the skeletal musculature is located in the human body (need for high energy in an individual impulse). However, with high energy delivered in individual impulses, the current from which spreads deep into the conducting body following Kirchgoff's rule, no pain shock is brought about in the receptor nerve endings located on the body's surface. Research conducted in the USA and Russia has shown that increasing the duration of the impulse to over 120-150 milliseconds makes it possible to substantially reduce (virtually by an order of magnitude) its energy in order to attain the operative mechanism of the EMD. However at the present time, the impulses in the widely-used high-voltage pulse transformers that meet other electrical performance requirements, including the chief performance property, "spark gap through air", do not exceed 20-40 milliseconds in duration.

At present, the electroshock devices of the leading worldwide firm, Taser International, Inc., use the EMD technology in applying the Shaped Pulse technology (that is, preliminarily ionizing the discharge gap with a low-energy initial discharge in order for a strong impulse from the storage capacitor to pass along an ionized air channel). In the Shaped Pulse technology, an increase in the KPD of a discharge from storage capacitor(s) is attained by arranging for it to be discharged without being directly transformed into a discharge gap between the target and the shock electrodes (tactical electrodes), ionized by the preliminary, low-power discharge from the high-voltage pulse transformer.

An electroshock device that uses the EMD/Shaped Pulse technology is known under US Patent Publication No. 2004/156,163. It contains an autonomous electrical power supply; a converter of the electric power supply's direct-current low voltage to a current of about 2,000 volts, which is removable from the coil 3-4 of the converter transformer T1; a storage capacitor C1 that is connected in parallel through a diode D1 to the converter's outlet; a circuit made of a sequentially connected low-voltage coil of the high-voltage outgoing pulse transformer T2 (see FIGS. 23 and 24 of the patent description); and a switch GAP1, for which a gas discharger is used, the ignition voltage of which is 15-50% lower than the outgoing voltage of the converter when empty. The high-voltage coil of the impulse transformer has two coils; capacitors C2 and C3 and gas dischargers GAP2 and GAP3 are connected to each coil. Capacitors C2 and C3 are charged from separate coils of converter transformer T1 through diodes D2 and D3. After capacitor C1 is discharged through the primary coil of transformer T2, voltage in the phased secondary coils of transformer T2 turns out to be enclosed in the Rn-E1-GAP2-C2-C3-GAP3-E2 loop. At the same time, a disruption occurs among the device's discharge (tactical) electrodes. After the E1-Rn-E2 air gap is ruptured by a high-voltage discharge, its resistance goes down as a result of the ionization of the air, due to which the charged capacitors C2 and C3 begin discharging through the above-indicated contour, providing the basic power for the impulse that strikes the target. This device, and the one in FIG. 25 of the patent (the basic operating principle of which does not differ from the one described here) have the following drawbacks:

1. The low frequency of the strike impulses (no more than 25 Hz) with substantial pulse energy, approaching that of the EMD technology. Such a device facilitates performance of the target-stopping function, but when it is switched off it fails to fulfill the function of capturing the target, since the operative mechanism of the STUN GUN is not realized when discharge frequency is very low while discharge energy is substantial.

2. The complexity of executing the T1 and T2 transformers due to the large number of coils and the complications involved in isolating them to prevent abnormal disruptions between the turns of the coil.

Another electroshock device that uses Shaped Pulse technology is known under Russian patent No. 2108526 (see diagram in patent description). It contains an electric power supply, a direct-current converter 3 to convert the power supply's low voltage into voltage current in order to charge the storage capacitor C4, which is sequentially connected to the low-voltage coil of the high-voltage outgoing pulse transformer and discharger. The supplemental capacitor C5 is connected in parallel to capacitor C4 through the diode D6 from voltage converter 3. The high-voltage impulse transformer is made in the form of an autotransformer, the central terminal of which is connected to a common point of both capacitors and to the terminal of converter 3. One tactical (target-impacting) electrode is connected to the end of the autotransformer's high-voltage coil, while the other is connected to the point where the supplemental capacitor and diode connect. When the device operates, the converter simultaneously charges capacitors C4 and C5, the discharger 7 (having a low breakdown voltage of about 1000-2000 volts) breaks and capacitor C4 discharges into the low-voltage portion of the autotransformer's coil. Capacitor C5 is prevented by diode D6 from discharging into the low-voltage coil. A high-voltage pulse, induced in the high-voltage portion of the autotransformer coil in the event the target's resistance is far removed from tactical electrodes 12 and 13, breaks discharger 11 (usually called the "cutting electrodes" of the electric shocker). The spark travels through the air between the cutting electrodes without causing a discharge of capacitor C5. If the target resistance is located at a distance from tactical electrodes 12 and 13 that is less than the spark gap between the cutting electrodes, the discharge to the target occurs between tactical electrodes 12 and 13 and the reduced resistance of the ionized discharge channel causes capacitor C5 to discharge into that channel, which increases the force of the discharge. For the purpose of eliminating any residual direct current from capacitor C5 in the event the device acts through the cutting electrodes (for example, in a demonstration), the safety discharger 14 engages in sequence with the high-voltage circuit, at a breakdown voltage greater than that of the charged capacitor C5. This device has the following drawbacks:

1. The chief requirement in using electroshock devices is the capability of releasing a demonstration discharge in front of an aggressive attacker, upon which, as practice has shown, the visibly powerful discharge of the electroshock gun (i.e. color, noise) is in most cases sufficient to psychologically deter an attack.

2. The chief requirement in the commercial use of electroshock devices (basic sales principle) is also the visual appearance of the discharge, i.e., its color and the noise it produces, on the basis of which the buyer chooses in favor of one or another model of electroshock gun. Electroshock guns, even those that are truly more effective in the physiological effect of their discharge, always lose out to electroshock guns whose discharge is less effective physiologically but more visually effective. A demonstration discharge by the above-described electroshock gun, produced through the cutting electrodes (discharger 11), has a poor visual effect, since it is arranged without a discharge by capacitor C5, which contributes considerable noise to the visual appearance of the discharge and visibly enlarges its spark. Thus the commercialization from sales of the above-described electroshock device to develop the market and, accordingly, create additional jobs does not exceed the commercialization of all other models of electroshock devices under production. At present, no electroshock devices are being produced under the above-cited patent.

3. The production of high-voltage pulse transformers, a crucial component of an electroshock device for the quality of manufacture required, with wire of various diameters for the parts of the common coil (as required under the above-cited patent) is technologically complex and fails to attract the attention of manufacturers, as shown by the complete absence of autotransformer electroshock devices on the market.

SUMMARY OF THE INVENTION

The invention's purpose is to create an electroshock device with a more effective physiological impact, one that uses Shaped Pulse technology and integrated STUN GUN/EMD technology, using simple production technologies to produce high-voltage pulse transformers, and is distinguished by the considerable visual effect of its demonstration release of electric discharge.

The increased effectiveness in the variants of the proposed electroshock device is achieved by combining parameters of the electrical impulses of the STUN GUN and EMD technologies. For this, variants of the proposed device employ parameters of electric discharges having frequencies of 100-200 Hz with pulse energy of at least 0.1 J and a pulse duration up to 1000 milliseconds, which allows one to achieve the goal of stopping and capturing the target. In other variants of the device, series of impulses based on STUN GUN technology alternate with separate impulses based on EMD technology in a single, uninterrupted electric discharge by which the target-stopping and target-capturing mechanisms are attained.

The simplicity of the production technology of the proposed device is achieved by using standard high-voltage impulse transformers, well-developed by manufacturers, with two coils (low-voltage and high-voltage).

The visual demonstration effect of the discharge is achieved exclusively from a device with cutting electrodes (a cutting discharger), using the Shaped Pulse technology.

1. The characteristic feature of the invention is the fact that a electroshock device, containing an autonomous power supply, an on/off switch, a converter of the power supply's low-voltage direct current to direct current of 600-6000 volts, a storage capacitor, and a circuit consisting of a high-voltage switch in the form of a pneumatic or gas discharger and a low-voltage coil of a high-voltage pulse transformer, connected in parallel to the outlet of the direct-current converter, an outgoing pneumatic discharger at 30-70 kW comprising the shock electrodes that are connected to the ends of the high-voltage coil of a low-voltage pulse transformer, is distinguished by the fact that it has an supplemental storage capacitor, one terminal of which is connected to one terminal of the direct-current converter. The second terminal is connected through a diode to the second terminal of the direct-current converter in order to charge the supplemental capacitor from the direct-current converter. The connection point of the first diode and the second terminal of the supplemental capacitor is in turn connected to the terminal of the second diode, which is activated in sequence with the first diode. The second diode is connected by the second terminal to a shock electrode and to the third diode, which is activated by the same terminal, counter to the second diode and the first diode and connected by the second terminal to one end of the high-voltage coil of the high-voltage pulse transformer. The other end of the high-voltage coil of the high-voltage pulse transformer is connected to the second shock electrode and to the first terminal of the supplemental storage capacitor, which is connected to the first terminal of the direct-current converter. The low-voltage or high-voltage coils of the high-voltage pulse transformer are phased with the outlet of the direct-current converter and the diodes; a pneumatic or gas discharger with an ignition voltage greater than the maximum charge voltage of the supplemental storage capacitor.

2. An electroshock device as in item 1, differing in that a limiting resistor is included in the charging circuit of the storage capacitor.

3. An electroshock device as in item 1, differing in that a discharge resistor is included in parallel in the charging circuit of the supplemental storage capacitor.

4. An electroshock device as in item 1, differing in that a fixed or adjustable limiting resistor is included in the charging circuit of the supplemental capacitor, in sequence with the first diode up to the point of connection with the terminal of the supplemental storage capacitor.

5. An electroshock device as in item 1, differing in that high-voltage diode assemblies are used as diodes.

6. An electroshock device as in item 1, differing in that the low-voltage coil of the high-voltage pulse transformer is shunted by a diode that is connected in reverse polarity to the working polarity of the storage capacitor.

7. An electroshock device containing an autonomous power supply, a switch, a converter of the power supply's direct-current voltage to direct current of 600-6000 volts, a storage capacitor, and a circuit made up of a high-voltage switch in the form of a pneumatic or gas discharger and the low-voltage coil of a high-voltage pulse transformer, connected in parallel to the outlet of the direct-current converter, an outgoing air discharger at 30-70 kW comprising the shock electrodes that are connected to the ends of the high-voltage coil of a low-voltage pulse transformer, distinguished by the fact that it has an supplemental storage capacitor, connected sequentially to the high-voltage coil of the high-voltage pulse transformer so that one terminal of the supplemental capacitor is in fact a shock electrode. One terminal of the supplemental capacitor is also directly connected to one terminal of the direct-current converter, while the other terminal of the supplemental capacitor is also connected to the other terminal of the direct-current converter through a diode. The low-voltage or high-voltage coils of the high-voltage pulse transformer are phased with the outlet of the direct-current converter and diode. A pneumatic or gas discharger with an ignition voltage that is greater than the maximum charge voltage of the supplemental storage capacitor is included in the discharge circuit of the supplemental capacitor.

8. An electroshock device as in item 7, differing in that a limiting resistor is included sequentially in the charging circuit of the storage capacitor.

9. An electroshock device as in item 7, differing in that a discharge resistor is included in parallel in the charging circuit of the supplemental storage capacitor.

10. An electroshock device as in item 7, differing in that a fixed or adjustable limiting resistor is included sequentially in the charging circuit of the supplemental storage capacitor.

11. An electroshock device as in item 7, differing in that the adjustable resistor is operated automatically depending on the frequency of the discharges of the supplemental capacitor, with a dependence of the increased resistance when increasing the frequency of the discharges of the supplemental capacitor.

12. An electroshock device as in item 7, differing in that the low-voltage coil of the high-voltage pulse transformer is shunted by a diode that is switched on in reverse polarity to the working polarity of the storage capacitor.

BRIEF DESCRIPTION OF THE DRAWINGS

The above and other features of the invention will become apparent upon reading the following written description, taken in conjunction with the accompanying drawings in which.

DETAILED DESCRIPTION OF THE PREFERRED EMBODIMENTS

Figure 1:
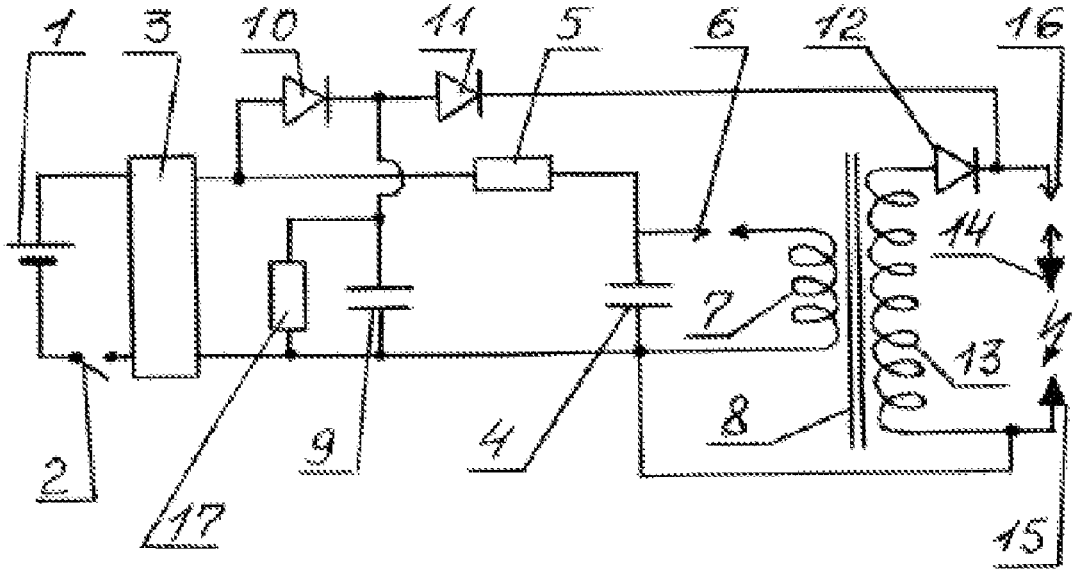
FIG. 1 is a circuit diagram of an electroshock device in accordance with an embodiment of the invention with limiting and discharge resistors using Shaped Pulse/EMD technology.

Diverse variations of the electroshock device may be employed as needed.

The electroshock device of the cartridge as in items 1, 2 and 3 of the claims (FIG. 1) consists of a low-voltage power supply (1), comprising a storage cell or battery, an on/off switch (2), a converter (3) of the power supply's low-voltage DC current to direct current of 600-6000 volts, a storage capacitor (4) that is connected to the converter (3) and is connected in parallel to a circuit consisting of limiting resistor (5) of a pneumatic or gas discharger (6) and a primary coil (7) of the high-voltage pulse transformer (8). The converter (3) is also connected to a supplemental storage capacitor (9), one plate of which is connected to the terminal of converter (3) directly, while the other plate is connected to a terminal of converter (3) through a diode (10). The plate of capacitor (9) that is connected to diode (10) is also connected to one terminal of diode (1), the second terminal of which is connected to one terminal of diode (12), the second terminal of which is connected to one end of the high-voltage coil (13) of transformer (8). The point of connection of diodes (11) and (12) is connected to one shock electrode (14) of the electroshock device. The other end of the coil (13) of transformer (8) is connected to shock electrode (15) of the electroshock device and to the common point of connection of capacitors (4) and (9) and the terminal of converter (3).

The low-voltage or high-voltage coils of the high-voltage pulse transformer (8) must be phased with the outlet of converter (3) and diodes 10, 11, and 12.

The device operates as follows: when the switch (2) is turned on, the converter (3) begins charging the capacitor (4)

through the limiting resistor (5), and [begins charging] the supplemental capacitor (9) through a diode (10). The limiting resistor (5) is needed to guarantee that capacitor (9) is fully charged before discharging capacitor (4) into the primary coil (7) of the transformer (8) and to the guaranteed full charge of capacitor (9) in the event its capacity exceeds that of capacitor (4). A diode (12) prevents capacitors (4) and (9) from discharging through the secondary coil (13) of transformer (8). When capacitor (4)'s charge potential reaches the ignition voltage of the discharger (6), the discharger is activated and capacitor (4) discharges through discharger (6) into the primary coil (7) of the transformer (8). At the same time the capacitor (9) remains charged, as it is prevented by diode (10) and resistance (5) from discharging into the circuit of discharger (6) and primary coil (7) of transformer (8). An induction EDS is induced at high potential within secondary coil (13) of transformer (8). A diode (11) prevents the shunting of high-voltage impulse current through capacitor (9) and (4). Between shock electrodes (14) and (15), the distance between which is selected for guaranteed disruption through the air under the potential developed by secondary coil (13) of transformer (8), and an airborne disruption occurs. At the same time, the resistance of the discharge channel between electrodes (14) and (15), which has been ionized by the disruption, falls abruptly and the capacitor (9) begins discharging into the ionized air channel through diode (11). Usually the application (a tactical discharge) of an electroshock device occurs through the attacker's clothing, that is, through air gaps determined by the thickness of the clothing. However in some instances the shock electrodes can be pressed directly against the target's skin covering, which has a resistance of about 1000 ohms. In this case, current from the converter (3) begins flowing along the loop: one terminal of converter (3), diode (10), diode (11), electrode (14), target resistance 1000 ohm, electrode (15), second terminal of converter (3). The destructive effect of the direct current of converter (3) is negligible, and the electroshock device ceases to be effective. In order to eliminate the flow of such a current through the indicated loop, a pneumatic or gas discharger (16) with an ignition voltage equal or greater than the maximum charge voltage of capacitor (9) is inserted between the shock electrode (14) and the connection point of diodes (11) and (12), or between electrode (15) and the point of contact of the end of the coil (13) and the common point of capacitors (4) and (9), or between the connection point of diodes (11) and (12), or between the point of contact of capacitor (9) and diode (11). The discharger (16) is depicted in FIG. 1, by way of example, between electrode (14) and the point of contact of diode (11) and diode (12) and fulfills the indicated function of keeping current from converter (3) from flowing along the indicated loop against the target's resistance up to the moment of ignition of the discharger (6) and emerging in correspondence to the high-voltage impulse of the transformer (8). When the high-voltage impulse of transformer (8) passes through the target's resistance of 1,000 ohm or less (down to one unit of ohm), the discharger (16), the ignition voltage of which is negligible compared to the high-voltage impulse from the coil (13), is ignited by the potential of the high-voltage impulse, ensuring that capacitor (9) will discharge through the target (or the air gap and the target). Besides the indicated function, discharger (16) ensures that of protecting the user from the effects of residual direct current on capacitors (4) and (9).

In order to increase the magnitude of the discharge current of the capacitor (9) on the target and preclude a disruption of the diodes by the high-voltage impulses of the secondary coil (13) of the transformer (8), high-voltage diode assemblies must be used for the diodes, with possibly greater magnitudes of allowable direct impulse current. After the switch (2) is turned off and the converter (3) has ceased operating, at a certain moment in time (before the capacitor (4) is fully charged and the discharger (6) has activated), the capacitor (9) remains undischarged and, after the converter (3) has turned off due to current leaking from diode (10), it begins to complete the charging of the capacitor (4). This kind of process occurs when the capacity of capacitor (9) is substantially greater than that of capacitor (4). When capacitor (4) is fully charged and the discharger (6) is activated, there occurs a single high-voltage impulse in the high-voltage transformer (8) on the disengaged device. This unexpected single impulse after the device has been turned off represents a hazard to the user. In order to eliminate this phenomenon, a high-resistance discharge resistor (17) is included in the charging circuit of the capacitor (9) and parallel to it. When the converter (3) is turned off, the residual charge of capacitor (9) flows to resistor (17), not allowing capacitor (4) to finish charging.

The discharge of capacitor (9) into the ionized channel occurs with each discharge of capacitor (4). The demonstration discharge thus differs from the prototype by its substantial visual effect and discharge noise.

The duration of the discharge impulse of the capacitor (9) in this device, as research has shown, can reach 1,000 milliseconds or more at a pulse frequency of 100-200 Hz. and over 0.2 J of energy per impulse. Thus the proposed device achieves a combination of the performance parameters of the electrical impulses of the STUN GUN and EMD technologies.

Figure 2:
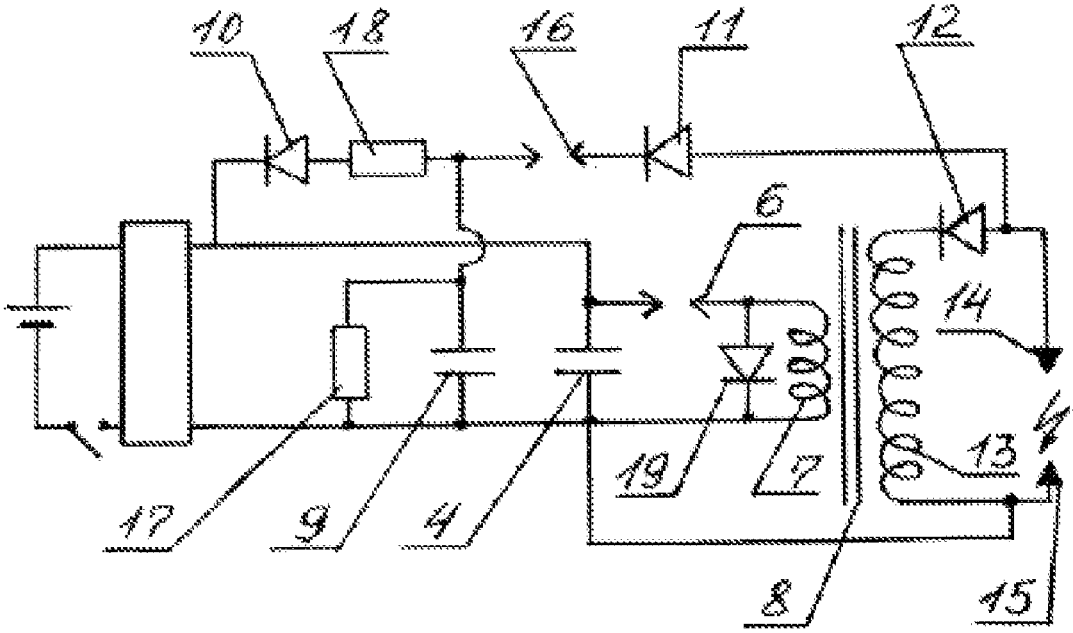
FIG. 2 is a circuit diagram of an electroshock device in accordance with another embodiment of the invention with discharge and fixed or adjustable limiting resistors using Shaped Pulse/STUN GUN/EMD technology, and a shunting diode of the low-voltage coil of the high-voltage transformer.

FIG. 2 depicts another embodiment of the electroshock device. This embodiment is distinguished by a different sequencing of the polarity for activating diodes 10, 11, and 12, which is possible with a different phasing of the coils of transformer (8), by the absence of limiting resistor (5). Compared to the description in FIG. 1 (since the position of the discharger (16) in the discharging circuit of the capacitor (9) has several variations), the discharger (16) in this variant of the device is included in the capacitor's discharging circuit between diode (11) and the terminal of the capacitor (9). In addition, a constant or trimming resistor (18) is introduced, to be included in the charging circuit of the supplemental capacitor (9) in sequence with diode (10), up to the point of contact of the terminal of the capacitor (9) and the discharger (16). The device works as follows: The charging speed of the capacitor (9) is determined by the size of the resistor (18), and is always less than that of capacitor (4). During the time it takes for capacitor (9) to charge up to the maximum voltage of the charge of capacitor (4), capacitor (4) has time to be charged up to the ignition voltage of the discharger (6) multiple times, and to discharge multiple times through discharger (6) and the primary coil (7) of transformer (8). The ignition voltage selected for discharger (16) is 2 to 2.5 times greater than that of discharger (6). The charge potential of the capacitor (9) cannot ignite the discharger (16), even if electrodes (14) and (15) were short-circuited, until the potential of the high-voltage impulse of the coil (13) is applied. At the same time, the capacitor (9) discharges through the discharger (16) into the ionized channel of the airborne spark between electrodes (14) and (15) as described in FIG. 1. After the capacitor (9) is discharged, the process described above is repeated.

By changing the resistance of the resistor (18), the capacity of the capacitor (9), and the ignition voltage of the discharger (16), one can set virtually any discharge frequency for capacitor (9) that is below the discharge frequency of capacitor (4). In this variant of the device, the discharger (16) simultaneously performs the function of protecting the user from the effect of the residual direct current on capacitors (4) and (9).

The practical (easily realizable) regulation of frequency is achieved by changing the resistance of resistor (18). The best physiological results from the effect of electrical impulses are achieved with the discharge frequency of capacitor (4) at 100-200 Hz, with individual impulse energy of 0.05-0.1 J, impulse duration of 10-40 milliseconds, and the discharge frequency of the capacitor (9) at 10-30 Hz; with impulse energy of 1.76 J its duration is 60 milliseconds or more. Thus this variant of the proposed device achieves a combination of the performance parameters of the electrical impulses of the STUN GUN and EMD technologies.

If there is a need to obtain monopolar, high-voltage impulses (aperiodical impulses) having increased physiological effectiveness from the transformer (8), the primary coil (7) of the transformer (8) is shunted by diode (19), which is connected in reverse polarity to the working polarity of the storage capacitor (4). In this event, diode (19) cuts the self-induction current of the primary coil (7) of transformer (8), cutting off the reverse polarity impulses on coil (13) of transformer (4). In addition, it prevents a reverse overcharge flow of the capacitor (4), which raises the device's electrical K.P.D.

Figure 3:
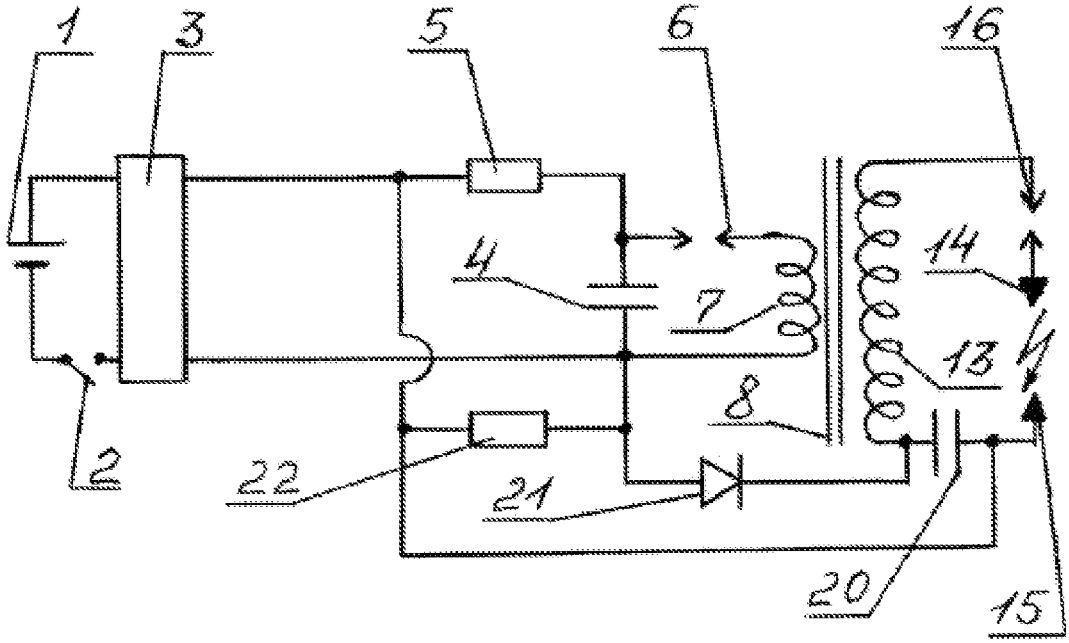
FIG. 3 is a circuit diagram of an electroshock device in accordance with another embodiment of the invention with limiting and discharge resistors using Shaped Pulse/EMD technology.

FIG. 3 depicts another embodiment of the invention consisting of a low-voltage power supply (1), comprising a storage cell or battery, a switch (2), a converter (3) of the power supply's low-voltage direct current to direct current of 600-6000 volts, a storage capacitor (4) that is connected to the converter (3) and is connected in parallel to a circuit consisting of a limiting resistor (5) of a gas or pneumatic discharger (6) and the primary coil (7) of the high-voltage pulse transformer (8). The supplemental storage capacitor (20) is connected sequentially to the high-voltage coil (13) of the high-voltage pulse transformer (8). At the same time, the terminal of the supplemental capacitor (20) is a shock electrode (15) and is directly connected to one terminal of the converter (3). The other terminal of the supplemental capacitor (20), connected to one end of the coil (13) through a diode (21), is also connected to the other terminal of the converter (3). A discharge resistor (22) is included in parallel in the charging circuit of the supplemental storage capacitor (20).

The low-voltage or high-voltage coils of the high-voltage pulse transformer (8) are phased with the outlet of the direct-current converter (3) and the diode (21). A pneumatic or gas discharger (16) with an ignition voltage greater than the maximum charge voltage of the supplemental storage capacitor is included in the discharging circuit of the supplemental capacitor (20).

The sequence of joining the diode (21) to one or another terminal of the capacitor (20), and the polarity of its connection in this device, have many variations and are determined by the phasing. The discharger (16) performs functions similar to those described for FIG. 1.

The device operates as follows: when the switch (2) is turned on, the converter (3) begins charging the capacitor (4) through the limiting resistor (5), and [begins charging] the supplemental capacitor (20) through a diode (21).

The limiting resistor (5) is needed to guarantee that capacitor (20) is fully charged before discharging capacitor (4) into the primary coil (7) of the transformer (8) in the event the capacity of capacitor 20 exceeds that of capacitor (4), which is advantageous in most cases.

When capacitor (4)'s charge potential reaches the ignition voltage of the discharger (6), the discharger is activated and capacitor (4) discharges through discharger (6) into the primary coil (7) of the transformer (8). At the same time the capacitor (20) remains charged, as it is prevented by diode (21) from discharging into the circuit of discharger (6) and primary coil (7) of transformer (8). An induction EDS is induced at high potential within secondary coil (13) of transformer (8). A diode (11) prevents the shunting of high-voltage impulse current through capacitor (9) and (4). Between shock electrodes (14) and (15), the distance between which is selected for guaranteed disruption through the air under the potential developed by secondary coil (13) of transformer (8), and an airborne disruption occurs. At the same time, the resistance of the discharge channel between electrodes (14) and (15), which has been ionized by the disruption, falls abruptly and the capacitor (20) begins discharging into the ionized air channel through the discharger (16), the ignition voltage of which is negligible compared to the voltage impulse of the secondary coil (12).

A discharge of capacitor (20) into the ionized channel occurs with each discharge of capacitor (4). The demonstration discharge thus differs from the prototype by its substantial visual effect and discharge noise. After the switch (2) is turned off and the converter (3) has ceased operating, at a certain moment in time (before the capacitor (4) is fully charged and the discharger (6) has activated), the capacitor (20) remains undischarged and, after the converter (3) has turned off due to current leaking from a diode (21), it begins to complete the charging of the capacitor (4). This kind of process occurs when the capacity of capacitor (20) is substantially greater than that of capacitor (4). When capacitor (4) is fully charged and the discharger (6) is activated, there occurs a single high-voltage impulse in the high-voltage transformer (8) on the disengaged device. This unexpected single impulse after the device has been turned off represents a hazard to the user. In order to eliminate this phenomenon, a high-resistance discharge resistor (22) is included in the charging circuit of the capacitor (20) and parallel to it. When the converter (3) is turned off, the residual charge of capacitor (9) flows to resistor (17) without allowing capacitor (4) to finish charging.

The duration of the discharge impulse of the capacitor (20) in this device, as research has shown, can reach 500-600 milliseconds or more at a pulse frequency of 100-200 Hz. and over 0.2 J of energy per impulse.

Thus the proposed device achieves a combination of the performance parameters of the electrical impulses of the STUN GUN and EMD technologies.

Figure 4:
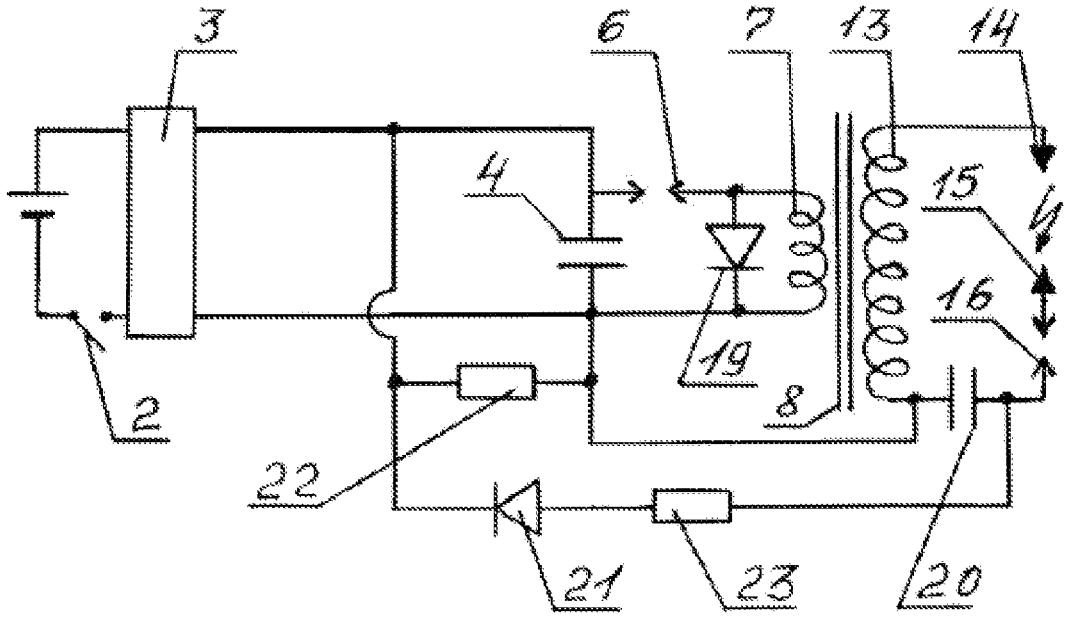
FIG. 4 is a circuit diagram of an electroshock device in accordance with another embodiment of the invention with discharge and fixed or adjustable limiting resistors using Shaped Pulse/STUN GUN/EMD technology, and a shunting diode of the low-voltage coil of the high-voltage transformer.

FIG. 4 depicts another embodiment of the electroshock device and differs by the absence of a limiting resistor (5) and the presence of a continuous or tuned resistance (23), which is connected sequentially to the charging circuit of the supplemental capacitor (20). The place where the resistor (23) is connected to the charging circuit of capacitor (20) could be any and is not reflected in the operation of the diagram.

The device operates as follows: when the switch (2) is turned on, the converter (3) begins charging the capacitor (4) and, through a diode (21), the supplemental capacitor (20). The charging speed of the capacitor (20) is determined by the magnitude of the resistance limiting resistor (23), and is always less than the charge speed of capacitor (4). During the time it takes for capacitor (20) to charge up to the maximum voltage of the charge of capacitor (4), capacitor (4) has time to be charged up to the ignition voltage of the discharger (6) multiple times, and to discharge multiple times through discharger (6) and the primary coil (7) of transformer (8). The ignition voltage selected for discharger (16) is 2 to 2.5 times or more than that of discharger (6). Between shock electrodes (14) and (15), the distance between which is selected for guaranteed disruption through the air under the potential developed by secondary coil (13) of transformer (8), and an airborne disruption occurs each time when capacitor (4) discharges. The current of the electric impulse induced in the secondary coil (13) passes through capacitor (20), however its discharge into the ionized air channel does not take place until the charge potential of capacitor (20) reaches a certain required magnitude defined by the conductivity of the ionized channel with a concentration of ionized particles in the ionized channel. Upon reaching the charge potential of capacitor (20) needed to charge it, capacitor (20) is discharged into the ionized channel. After the discharge of the capacitor (20), the above process is repeated.

By changing the resistance of the resistor (23), the capacity of the capacitor (20), and the distance between the shock electrodes (14 and 15), one can set virtually any discharge frequency for capacitor (20) that is below the discharge frequency of capacitor (4). In this variant of the device, the discharger (16) simultaneously performs the function of protecting the user from the effect of the residual direct current on capacitors (4) and (20), and of not allowing capacitor (20) to discharge until it is completely discharged upon the direct contact of electrodes (14) and (15) and the target resistance at 1000 ohm.

If there is a certain distance-marked air space between shock electrodes (14) and (15) and the load resistance (the target), the pulse frequency of the capacitor's (20) discharge impulses is constant, but as the air space is reduced and the resistance between electrodes (14) and (15) brought closer to 14 and 15 to 1,000 ohm. The discharge frequency of capacitor (20) increases and strives to approximate the discharge frequency of capacitor (4). Frequency regulation (reducing the discharge frequency of capacitor (20) and reducing the size of the air space) is achieved by increasing the resistance in resistor (23), depending on the magnitude of the discharge frequency of the capacitor (20). Such a regulation is best carried out automatically, i.e., with the help of a supplemental device that measures the pulse frequency of the discharge impulses of the capacitor (20) and, depending on its increase, increases the resistance of resistor (23).

The need to have an air space (substantial resistance) between electrodes (14) and (15) in order for this variant of the device to work with the high-frequency discharge of capacitor (4) and the slight frequency discharge of capacitor (20), allows one to apply it in contact electroshock devices that act through clothing, and in remote electroshock devices (DEShU) not having a needle to penetrate the clothing, that is, a DEShU with adhesive (sticky) probe electrodes. The best physiological results on the effect of electrical impulses are achieved under the characteristics indicated in the description of FIG. 2. Thus in one variant of the proposed device, a combination of the parameters of the electrical impulses of the STUN GUN and EMD technologies is being achieved.

When there is a need to derive monopolar, high-voltage impulses (aperiodic impulses), possessing increased physiological effectiveness, from the transformer (8), the first coil (7) of transformer (8) is shunted by diode (19), connected in a monopolar fashion in relation to the working polarity of the storage capacitor (4). In this case, diode (19) cuts the self-induction current of the primary coil (7) of the transformer (8), intercepting the impulses of reverse polarity on the coil (13) and transformer (4), and also prevents a reverse current over-charging the capacitor (4), which raises the device's electric KPD.

What is claimed is:

1. An electroshock device for contact or remote impact of targets with electric current, comprising: a low voltage direct current power supply, a converter connected by a switch to said power supply, said converter having an output of 600-6000 volts; a storage capacitor; a circuit consisting of a high-voltage switch in the form of a first discharger and a low-voltage coil of a high-voltage pulse transformer connected in parallel to one terminal of said converter, a second discharger operative at 30-70 kW comprising first and second shock electrodes connected to the high-voltage coil of said transformer; a supplemental storage capacitor, one terminal of which is connected to one terminal of said converter, the other terminal of which is connected through a first diode to a second terminal of said converter whereby said supplemental capacitor is in a charging circuit from said converter, said first diode and a second terminal of said supplemental capacitor connected to a first terminal of a second diode for activation in sequence with said first diode, said second diode connected by a second terminal to the first shock electrode and to a third diode, which is activated by the same terminal, counter to said second diode and said first diode and connected by a second terminal to one end of the high-voltage coil of said transformer, the other end of the high-voltage coil of the high-voltage pulse transformer connected to said second shock electrode and to the first terminal of the supplemental storage capacitor, which is connected to the first terminal of the direct-current converter, the low-voltage or high-voltage coils of said high-voltage pulse transformer being phased with the output of the converter and said diodes wherein said second discharger has an ignition voltage greater than the maximum charge voltage of said supplemental storage capacitor.

2. The electroshock device as recited in claim 1 including a limiting resistor in the charging circuit of the storage capacitor.

3. The electroshock device as recited in claim 1 including a discharge resistor is included in parallel in the charging circuit of the supplemental storage capacitor.

4. The electroshock device as recited in claim 1 including a fixed or adjustable limiting resistor in the charging circuit of the supplemental capacitor, in sequence with the first diode up to the point of connection with the terminal of the supplemental storage capacitor.

5. The electroshock device as recited in claim 1 wherein said diodes are high-voltage diode assemblies.

6. The electroshock device as recited in claim 1 wherein the low-voltage coil of the high-voltage pulse transformer is shunted by a diode that is connected in reverse polarity to the working polarity of the storage capacitor.

7. An electroshock device comprising: an autonomous power supply connected by a switch to a converter for providing an output of 600-6000 volts, a storage capacitor, and a circuit made up of a high-voltage switch in the form of a pneumatic or gas first discharger and the low-voltage coil of a high-voltage pulse transformer, connected in parallel to the outlet of said converter, a second discharger operative at 30-70 kW comprising the shock electrodes that are connected to the ends of the high-voltage coil of said transformer; a supplemental storage capacitor connected sequentially to the high-voltage coil of said transformer so that one terminal of said supplemental capacitor is a shock electrode, one terminal of said supplemental capacitor is directly connected to one terminal of said converter, the other terminal of said supplemental capacitor connected to the other terminal of said converter through a diode, the low-voltage or high-voltage coils of the high-voltage pulse transformer being phased with the outlet of said converter and said diode wherein said second discharger has an ignition voltage greater than the maximum charge voltage of the supplemental storage capacitor is operative in the discharge circuit of the supplemental capacitor.

8. The electroshock device as recited in claim 7 wherein a limiting resistor is included sequentially in the charging circuit of the storage capacitor.

9. The electroshock device as recited in claim 7 wherein a discharge resistor is included in parallel in the charging circuit of the supplemental storage capacitor.

10. The electroshock device as recited in claim 7 wherein a fixed or adjustable limiting resistor is included sequentially in the charging circuit of the supplemental storage capacitor.

11. The electroshock device as recited in claim 7 wherein the adjustable resistor is operated automatically depending on the frequency of the discharges of the supplemental capacitor, with a dependence of the increased resistance when increasing the frequency of the discharges of the supplemental capacitor.

12. The electroshock device as recited in claim 7 wherein the low-voltage coil of the high-voltage pulse transformer is shunted by a diode that is switched on in reverse polarity to the working polarity of the storage capacitor.

* * * * *